US008021191B2

(12) United States Patent
Long

(10) Patent No.: US 8,021,191 B2
(45) Date of Patent: Sep. 20, 2011

(54) CONNECTOR WITH TWO-PIECE HOUSING

(75) Inventor: Jerry A. Long, Elgin, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/636,110

(22) Filed: Dec. 11, 2009

(65) Prior Publication Data

US 2010/0151736 A1 Jun. 17, 2010

Related U.S. Application Data

(60) Provisional application No. 61/122,102, filed on Dec. 12, 2008.

(51) Int. Cl.
*H01R 24/00* (2011.01)

(52) U.S. Cl. ..... 439/626

(58) Field of Classification Search ..... 439/680, 439/626, 377, 55, 59, 636, 637, 61, 62, 64, 439/65, 67, 74, 77, 76.1, 79, 701
See application file for complete search history.

(56) References Cited

U.S. PATENT DOCUMENTS 6,390,857 B1 * 5/2002 Pickles et al. ..... 439/680
6,808,419 B1 * 10/2004 Korsunsky et al. ..... 439/607.23
6,866,549 B2 * 3/2005 Kimura et al. ..... 439/701

* cited by examiner

*Primary Examiner* — Edwin A. Leon
(74) *Attorney, Agent, or Firm* — Stephen L. Sheldon

(57) ABSTRACT

A connector includes a housing that is formed of a first and second section (the two sections which may be interlocking pieces) and has a hollow interior that is filled with a set of terminals. The housing pieces have a complementary engagement rail and channel that allows the two sections to be joined together in a structurally acceptable manner.

13 Claims, 10 Drawing Sheets

CONNECTOR WITH TWO-PIECE HOUSING

REFERENCE TO RELATED APPLICATIONS

This application claims priority to U.S. Provisional Application Ser. No. 61/122,102, filed Dec. 12, 2008, which is incorporated herein by reference in its entirety.

BACKGROUND OF THE INVENTION

The present invention relates generally to connector housings, and more particularly to connector housings used for connectors with terminals supported by wafers.

Connectors are well known in the art. As data rates have increased and stacked connectors have become more common, connectors have begun to utilize terminal assemblies that are inserted into a connector housing rather than single terminals stitched into the housing. These terminal assemblies often are formed as wafers that have a plastic frame that supports a plurality of conductive terminals. Thus, a connector may include a number of wafers supported by a housing. One problem encountered in the electronic industry is that the trend toward reducing the size of the electronic devices can lead to the use of connector housings that have reduced structural reliability.

Connector housings tend to be molded from a plastic resin and at present, care must be taken to ensure that the housing walls are made thick enough to prevent the walls from warping or bowing and either complicating, or preventing all together the insertion of all of the terminal assemblies into the housing at once. If the walls are too thin, they tend to bow and thus reduce the dimensions of the housing interior to a point where the terminal assemblies can not be inserted as a mass but need to be inserted individually with pressure applied to the housing walls to counteract their bow. If tolerances are provided to allow the wafers to be inserted, then the position of the wafers with respect to the housing is difficult to control. Therefore, further improvements in the connector housing would be appreciated be certain individuals.

SUMMARY OF THE INVENTION

A connector housing includes a first section and a second section that are configured to be joined together and provide a hollow interior cavity that can support a set of wafers. The first section includes a first and second card slot, the card slots configured to receive a paddle card from an opposing connector. Each wafer can be configured to provide a desired terminal configuration and the wafers can be positioned in a predetermined configuration. Each of the wafers includes a first and second terminal, the first terminal configured to extend to the first card slot and the second terminal configured to extend to the second card slot. The terminals each include a contact end that is received in terminal-receiving cavities formed in the card slots and a tail portion configured to be mounted on a circuit board. Each wafer can be configured to engage the first section so as to secure an orientation of a first portion of the wafer that supports the contact end. The second section is configured to be positioned around three sides of the set of wafers and helps support an orientation of a second portion of the wafers.

BRIEF DESCRIPTION OF THE DRAWINGS

In the course of this detailed description, reference will be made to the attached drawings in which.

DETAILED DESCRIPTION OF THE INVENTION

The detailed description that follows describes exemplary embodiments and is not intended to be limited to the expressly disclosed combination(s). The embodiments depicted below illustrate an embodiment of a connector housing with a first and second section that interlocks together. As can be appreciated, this can provide the benefit of reducing the occurrence of long, unsupported lengths in the housing so as to avoid bowing. Other benefits include the ability to facilitate mass production of the connectors by allowing the wafers in a connector to be inserted into the first section in a ganged manner (e.g., all at once) after being supported by the second section. Of course, the depicted design can provide various benefits, depending on its configuration and the selection of the partial features that are included will be based on design needs of the particular connector. Accordingly, the detailed description that follows is not intended to be limited to the illustrated embodiments but instead is intended to cover other combinations of features that are disclosed but might not be included in the particular combination for purposes of brevity.

Figure 1:
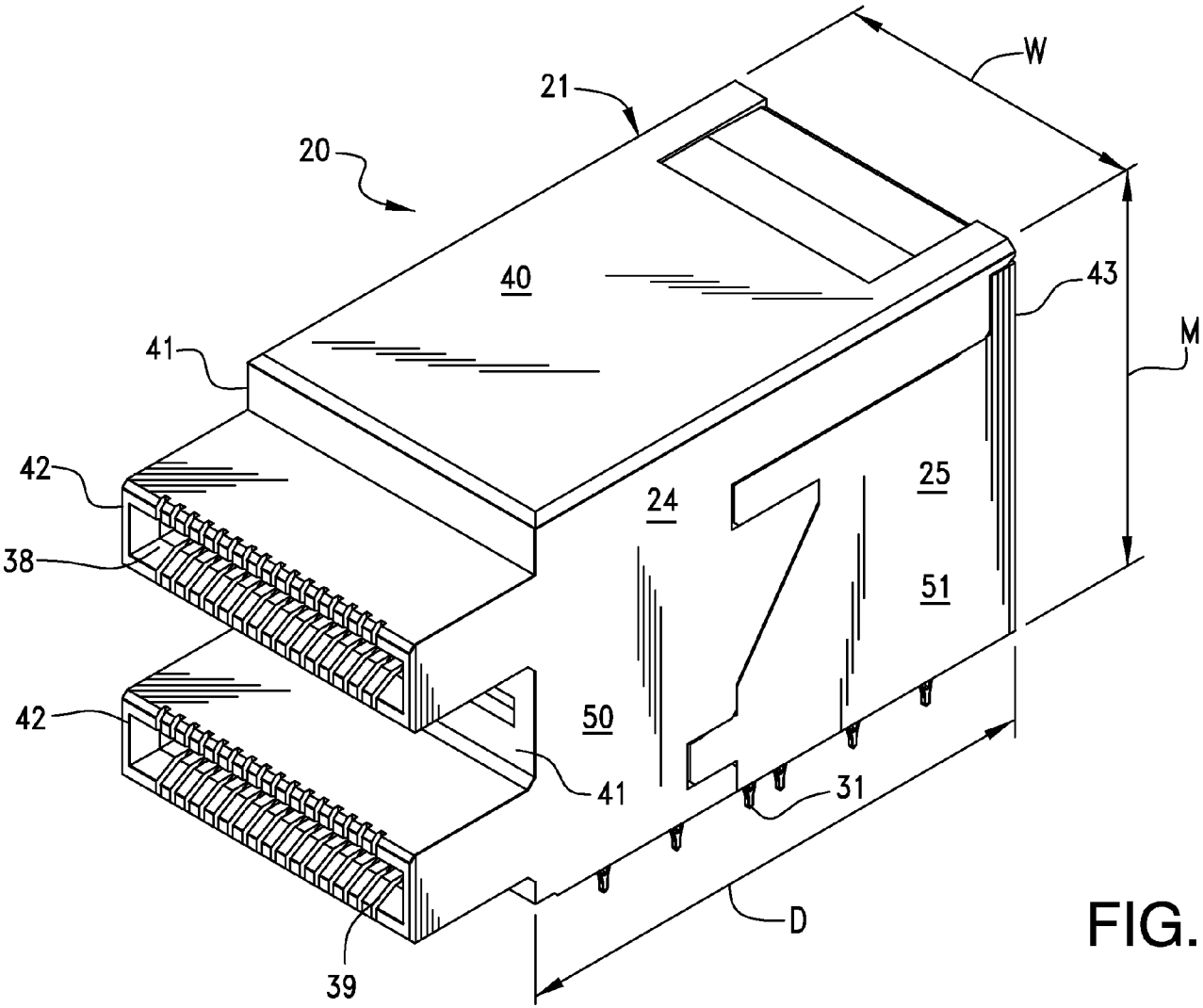
FIG. 1 is a perspective view of an embodiment of a connector housing.
Figure 2:
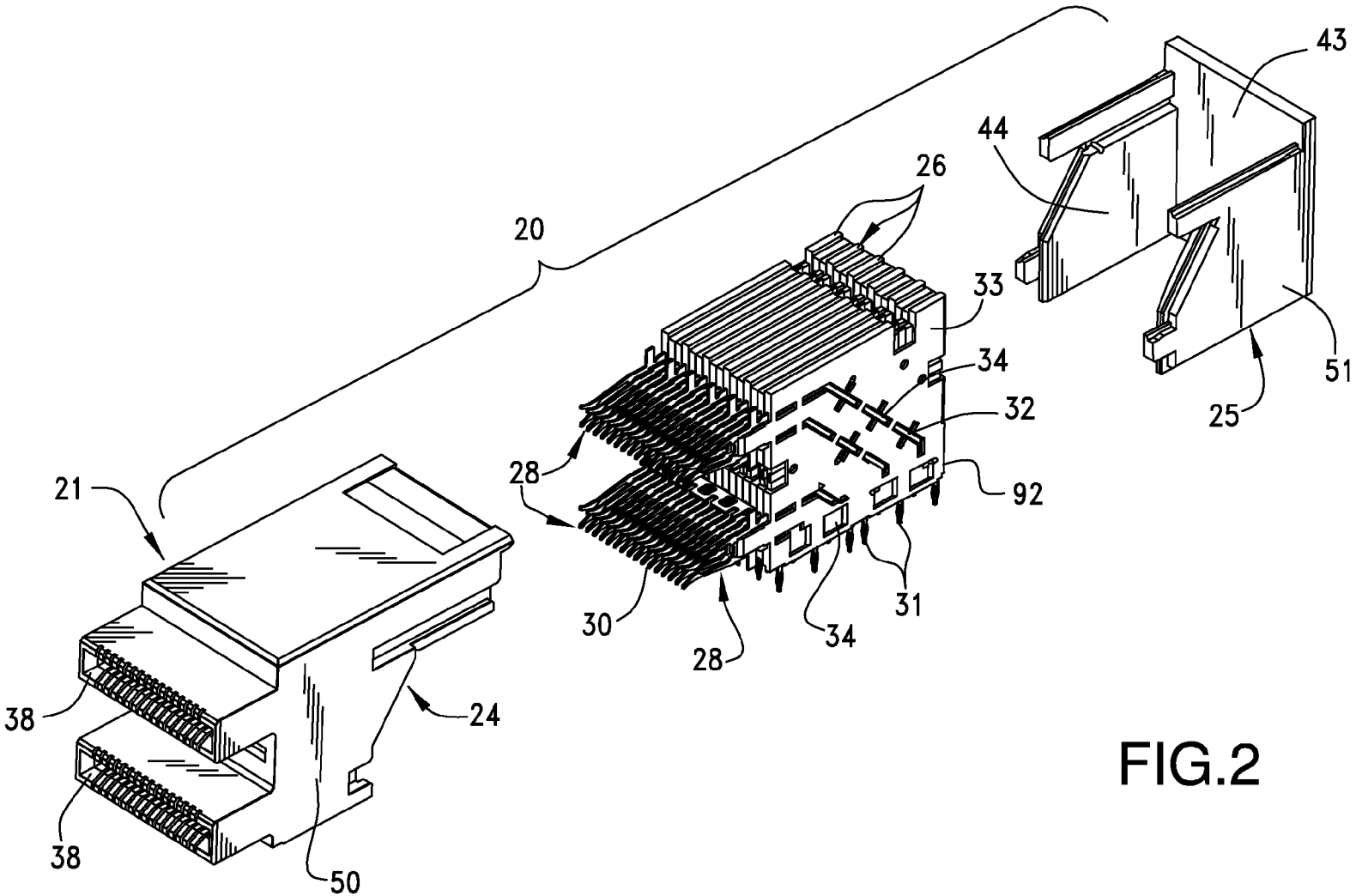
FIG. 2 is an exploded view of the connector of FIG. 1.

FIG. 1 illustrates a connector 20 having a housing 22 formed in two pieces, a first section 24 and a second section 25. The connector 20, as best shown in FIG. 2, includes a plurality of wafers 26 (e.g., a set of wafers 29) that are arranged in side-by-side order. Each wafer 26 supports a plurality of conductive terminals 28 that each include a contact portion 30, a tail portion 31 and a body portion 32 interconnecting the contact and tail portions 30, 31 together. The terminals 28 are supported by a dielectric support 33. The support 33 may include openings shown in the form of slots 34 that follow the path of the terminals 28 through the wafer 33.

The connector housing 22 is shown with two slots 38 into which edge cards (not shown) may be inserted. The slots 38 may extend forwardly of a front wall 41 as shown. The receptacle portions have a plurality of terminal grooves 39 formed on each side of the slots 38. Each terminal groove 39 can receive a single contact portion 30 of a terminal 28. Thus, for a connector with two slots that are each two sided, a wafer 26 can include two pairs of terminals, each pair being associated with one of the two slots.

The terminals 28 in the set of wafers 29 can be configured so as to provide pairs of differential signal terminals with contact portions positioned in slots. This can be provided by having the terminals arranged in a ground, signal, signal arrangement with each terminal being position in a separate wafer and two or more pairs of signal terminals being positioned in each slot. In an embodiment, each wafer may be configured to only provide signal or ground terminals.

As illustrated, the connector housing has a width W, a height H and a depth D. Connectors that provide two card slots tend to utilize a housing with a depth that is greater than the height. Therefore, the housing tends to need to have long walls, which are prone to warping and other post molding damage. In order to mold such a housing effectively, the walls of the housing tend to be molded relatively thickly. The depicted configuration, however, allows for a deep connector without requiring thick walls.

The housing 21 can be seen to have a top wall 40, a front wall 41, two nose portions 42 that extend forwardly of the front wall 41. As shown in FIG. 2, the housing further has a rear wall 43 that closes off an interior cavity or space 44, that extends between the front and side walls 41, 43 and two opposing spaced apart side walls 45, 46.

Figure 3:
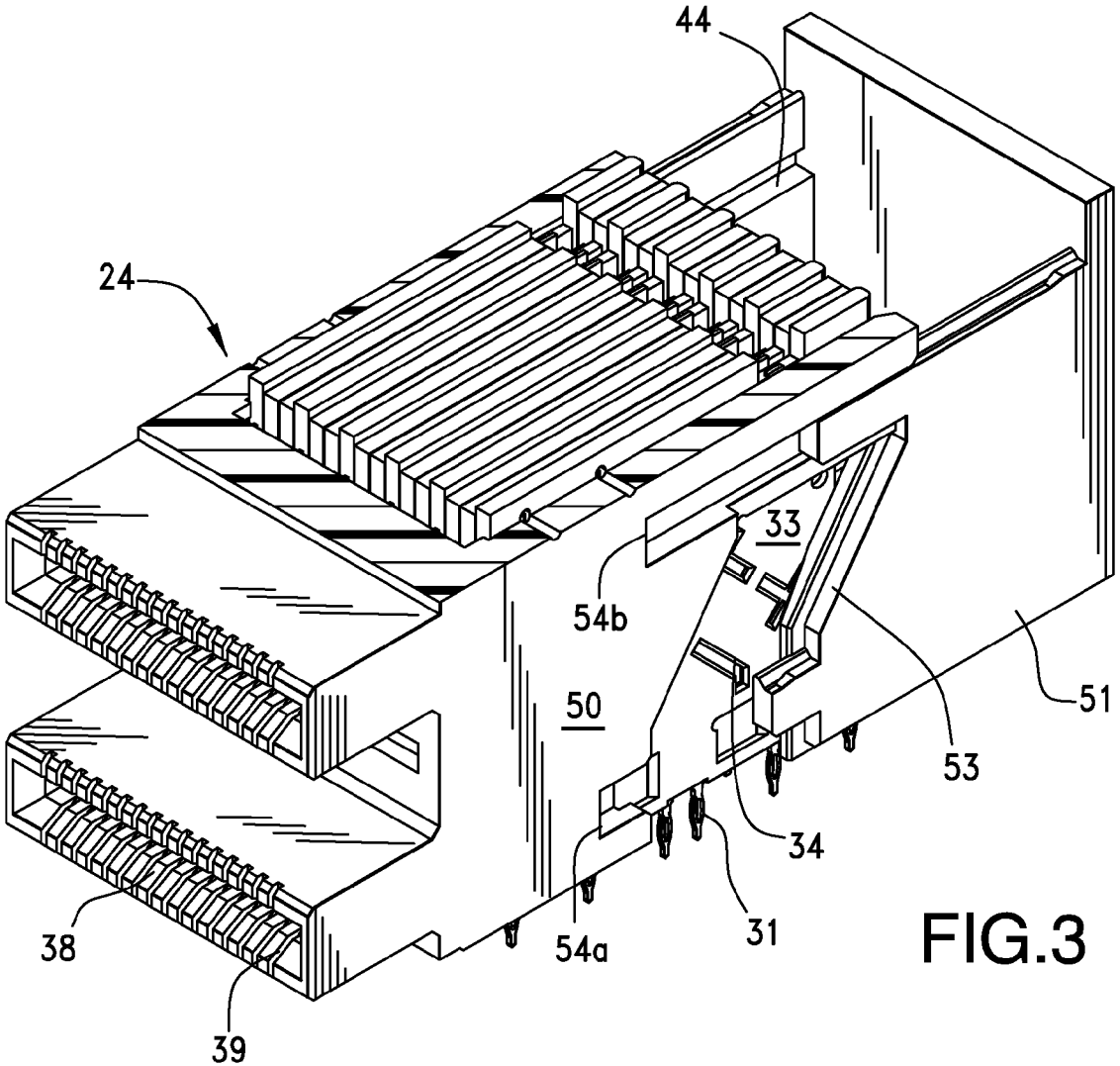
FIG. 3 is the same view as FIG. 1 but with the two housing sections partially separated and a top of the first housing section removed for clarity.
Figure 4:
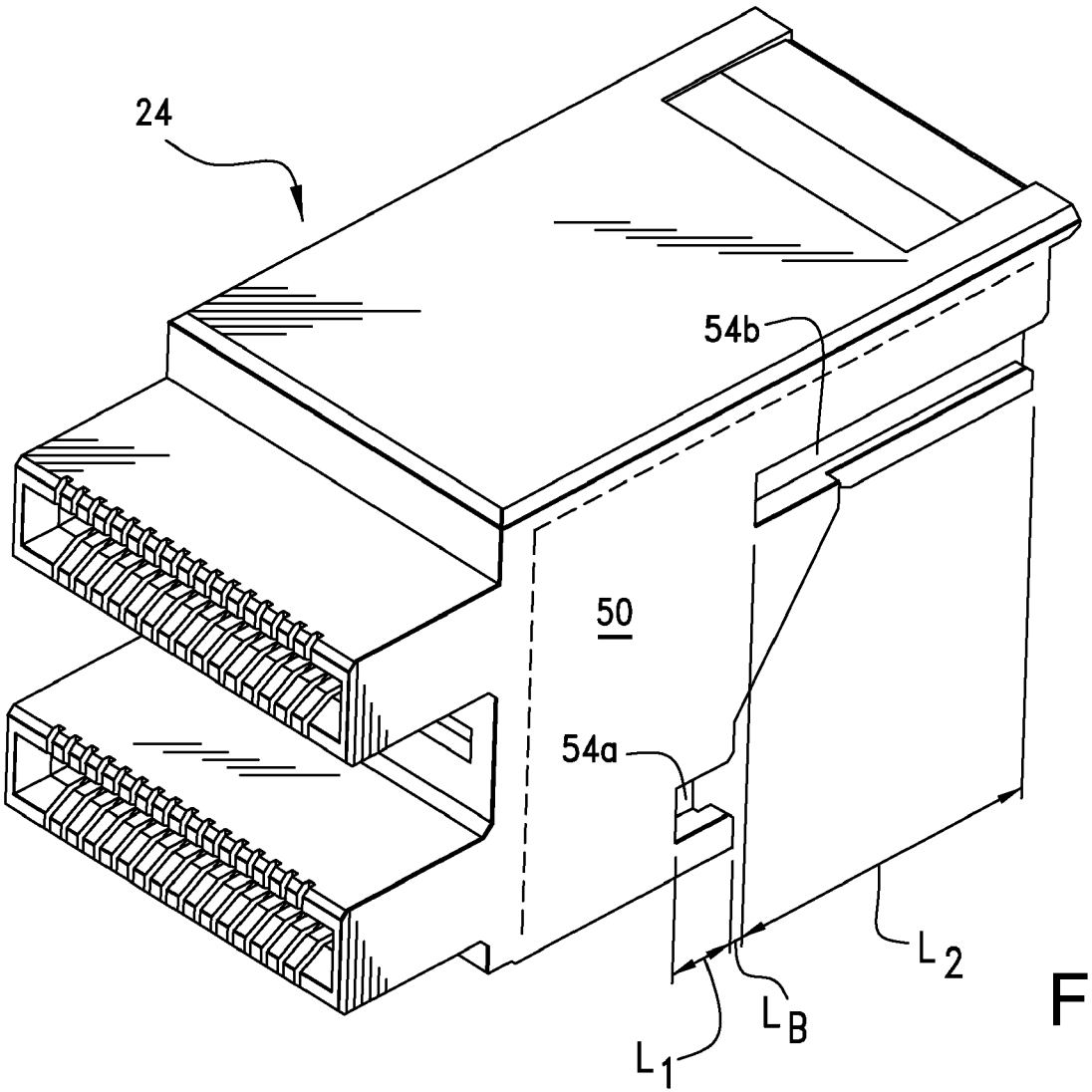
FIG. 4 is a perspective view of the first section of the connector housing of FIG. 1.
Figure 5:
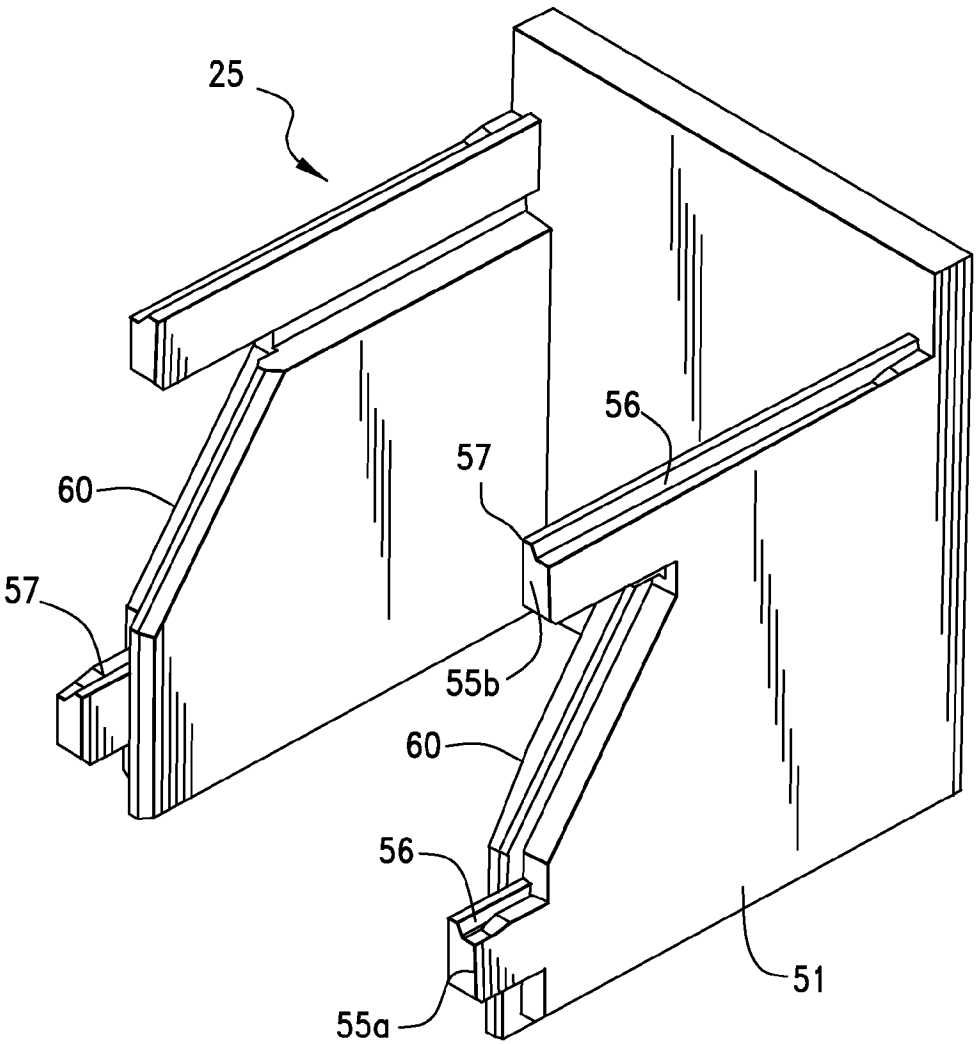
FIG. 5 is a perspective view of the second section of the connector housing of FIG. 1.
Figure 6:
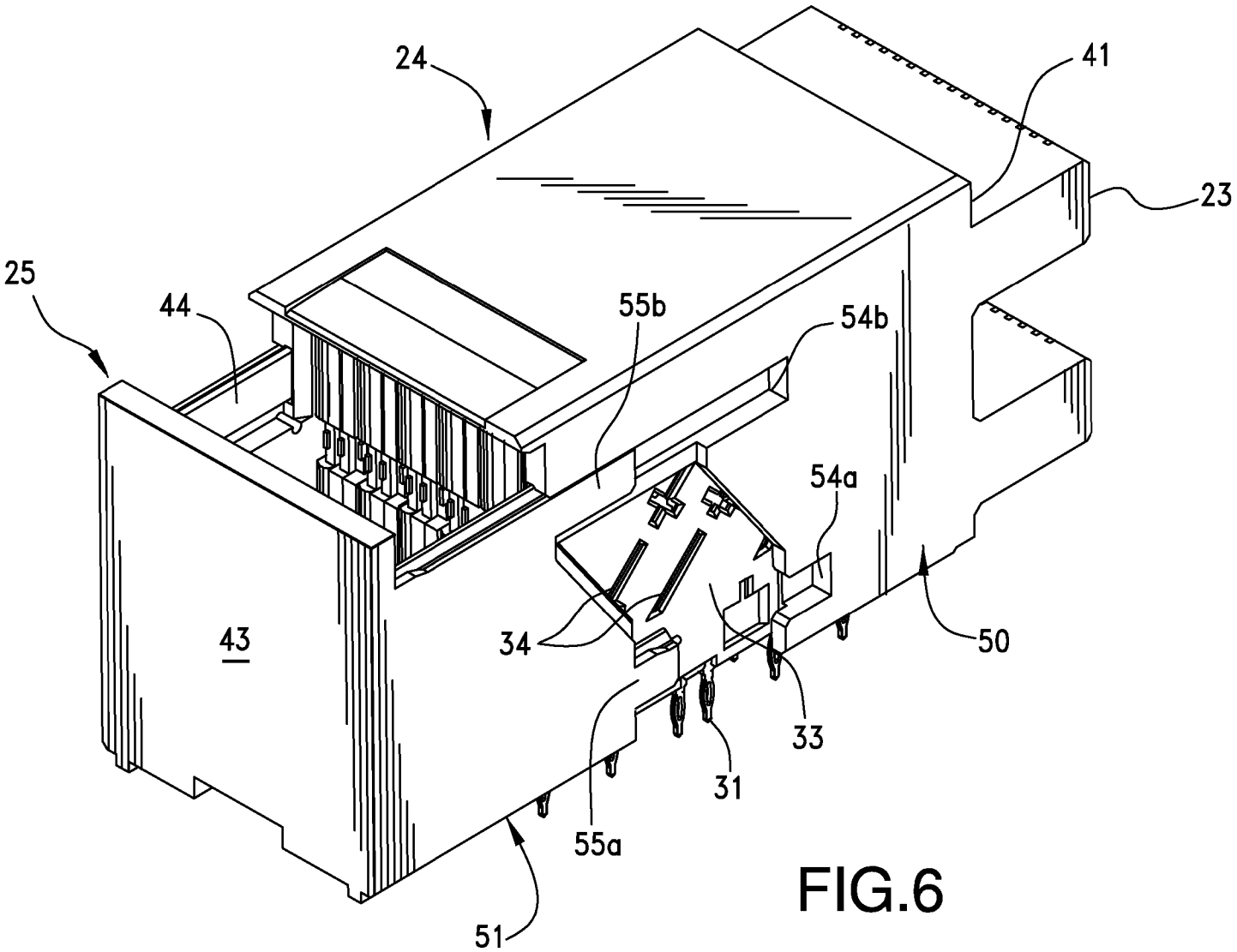
FIG. 6 is the same view as FIG. 1, taken from the rear with the two housing sections partially separated.
Figure 7:
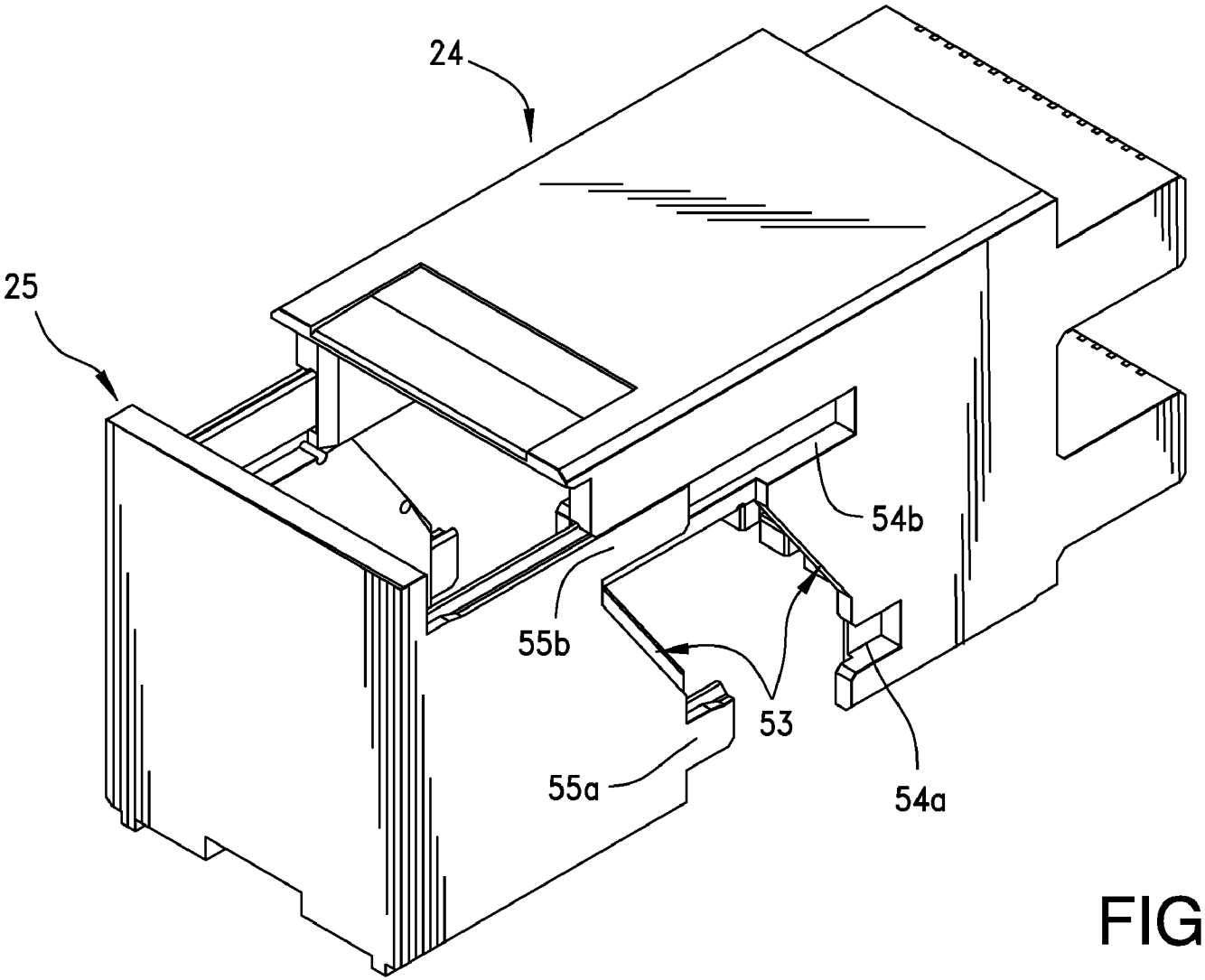
FIG. 7 is the same view as FIG. 6 but with the terminal assemblies removed for clarity.

As shown in FIG. 3, the engagement of the first and second section 24, 25 occurs along an irregular and non-linear engagement edge 53. One potential advantage of such a configuration is the ability to distribute forces over an area. A more regular engagement edge, however, may also be used if desired. The first section 24 has a pair of channels 54*a*, 54*b* formed in each of its two sidewalls. The channels 54*a*, 54*b* are spaced apart from each other in the vertical direction with one channel 54*a* being a lower or bottom channel and the other channel 54*b* being an upper channel.

The second section 25 has a pair of rails 55*a*, 55*b* that mate with corresponding channels 545*a*, 54*b*. The rails 55*a*, 55*b* preferably include grooves 56 formed in their upper surfaces 57 and these grooves 57 may receive raised ribs (not shown) formed in the upper surfaces of the two channels 54*a*, 54*b*. The rails 55*a*, 55*b* (and corresponding channels 54*a*, 54*b*) can have different lengths and need not be symmetrically located on both side walls 41,43. The bottom channel rails have a length $L_1$ while the top channel and rail each have a length $L_2$ which is greater than $L_1$. However, it is desirable that there is an intervening space, $L_B$ interposed between the end of the upper channel 54*b* and the beginning of the lower channel 54*a*.

Figure 10:
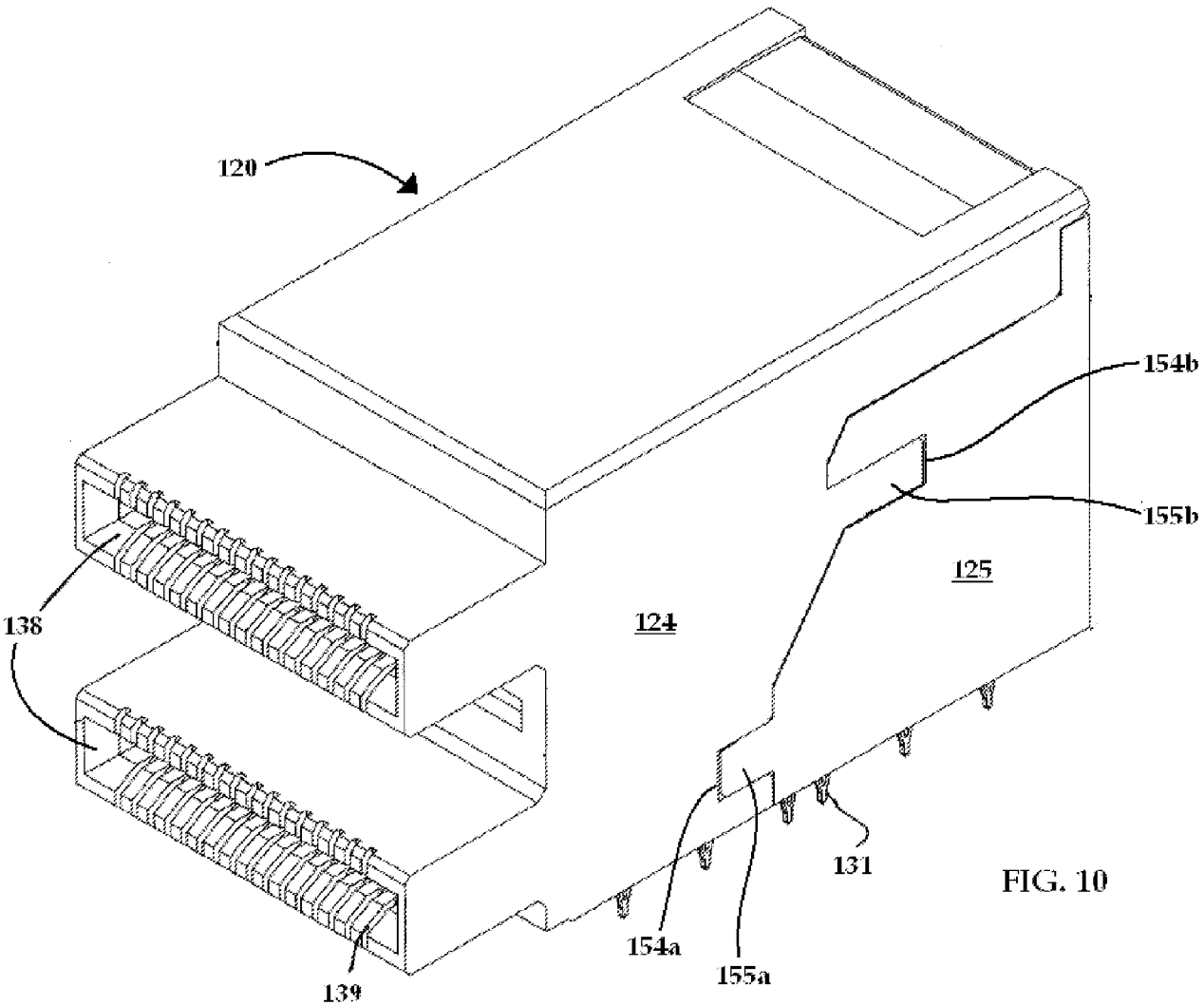
FIG. 10 is a perspective view of an embodiment of a connector housing.

It should be noted, as can be appreciated from FIG. 10, if corresponding rails and channels are provided in a connector 120 that has a housing comprised of a first and second section 124, 125 and the first section 124 has two card receiving slots 138 that each have terminal grooves 129, the first section 124 could have a rail 155*b* and a channel 154*a* and the second section 125 could have a rail 155*a* and a channel 154*b*. Thus, placing either the rail and/or channel on a particular side is not critical and can be modified as desired. In general, however, it is beneficial for the second section to be able to wrap around three sides of the wafer set.

The depicted irregular nature of the mating edge is defined in part by a face 60 that extends (at an upward angle in the figures) between the two rails or channels. This face 60 intersects the axis of the rails or channels. The combination of the irregular shape of the mating face and the rails and channels helps allow the thickness of the housing to be reduced to between about 0.050 inches to 0.100 inches and in an embodiment can be 0.060 inch thick.

Figure 8:
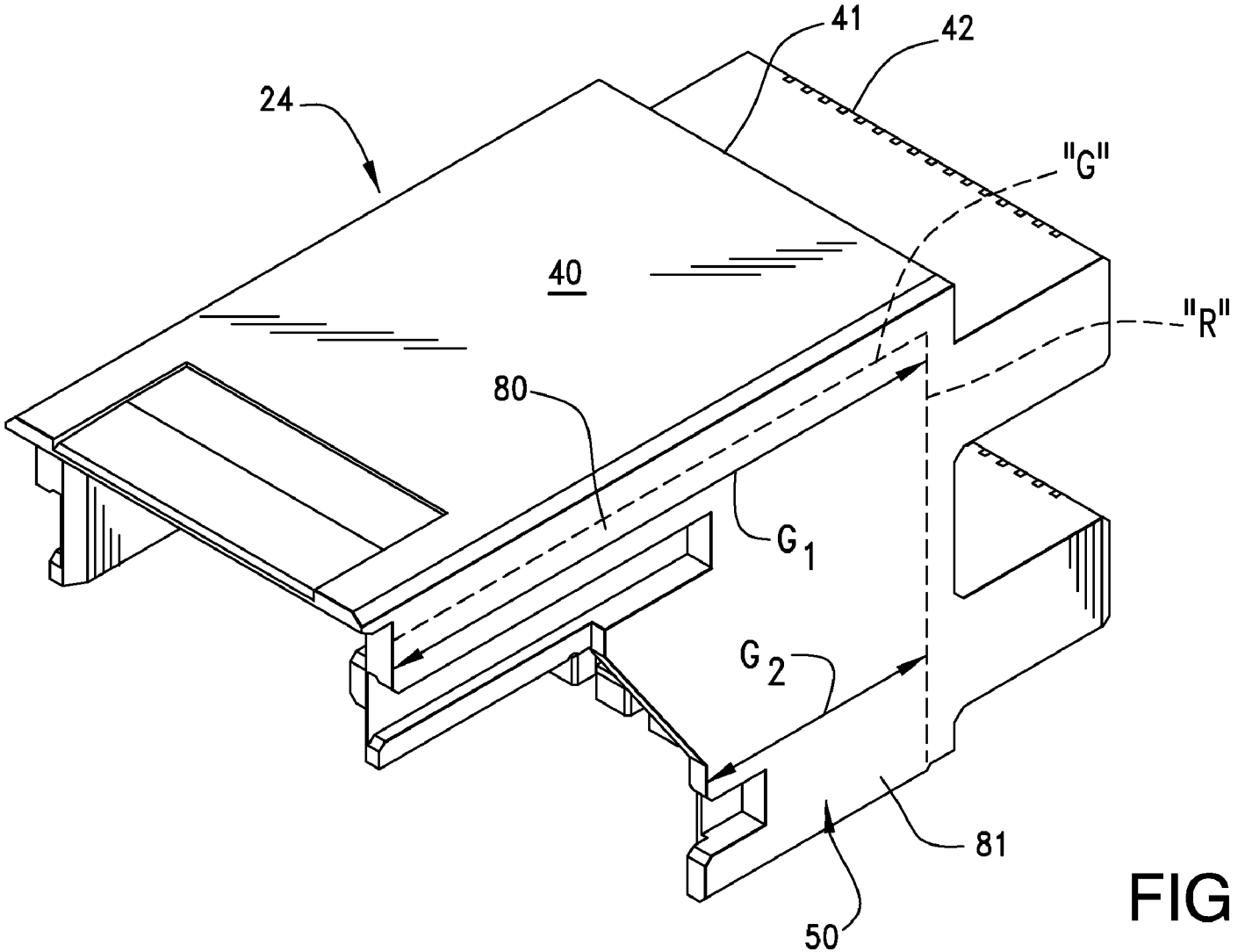
FIG. 8 is the same view as FIG. 7 but with only the first section shown.

Furthermore, the irregular nature of the mating face projects one part of the rear housing piece 51 forward, i.e. the lower part while moving the remaining part, the top part with a short length. This configuration reduces the unsupported length of the lower part. This can best be understood with reference to FIG. 8. The dashed line at "G" represents the inner surface of the top wall 40 and it can be seen that the side wall and the upper channel 54*b* extend for a short height or along where they are joined to the top wall. So the top part 80 of the side wall of the housing front piece has a short unsupported dimension. This short unsupported height extends for a good part-almost half of the top length $G_1$. (FIG. 8.) That is, its height is small at the tailing edge of its mating edge. This short unsupported length is then not prone to bowing or warping of the molding. The leading edge of its mating edge that defines the lower part 81 of the housing front piece is also spaced closely to the inner surface R of the front wall 41 resulting in a short unsupported length $G_2$.

Figure 9:
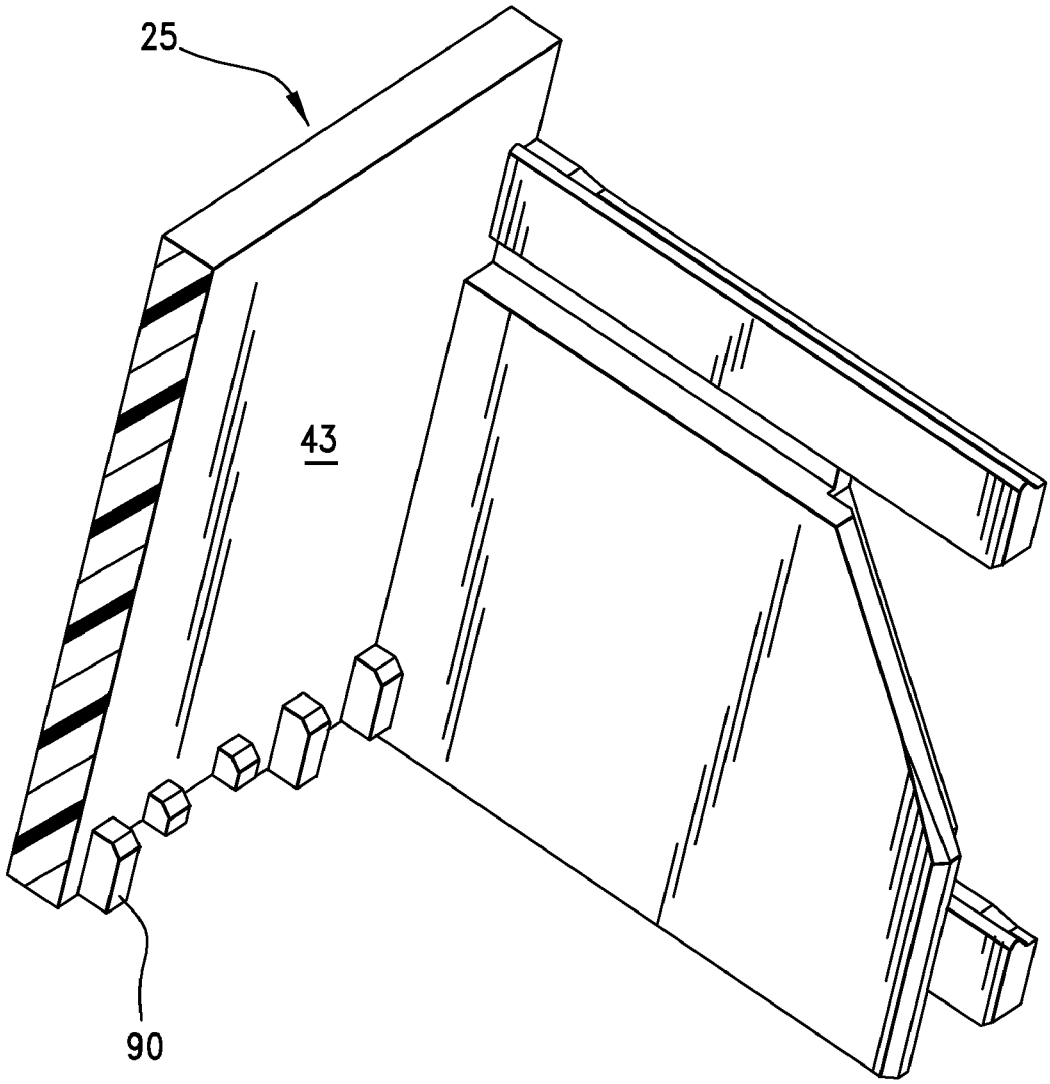
FIG. 9 is a perspective view of a second section, partially in section, illustrating the terminal assembly engagement pegs.

Similarly, as shown in FIG. 9, the second section also has an irregular mating face so that the side wall portions thereof have an unsupported length that is such that it does not bow or warp after molding. The rear wall 43 may have one or more registration lugs 90 disposed thereon and spaced apart from each other. These lugs can engage wafers with varying depth or can be configured to fit into notches 92 that are formed on the rear edges of selected terminal assembly wafers, such as wafers containing ground signals, in order to apply a pressure to the wafers and to control the set of wafer position with respect to the second section when the housing is assembled to ensure proper seating of the wafers in the connector housing.

The difference in lengths (in the depth direction) of the top and bottom channels or rails can provide the longer channel with a depth sufficient to initially guide the housing rear piece into place. In an embodiment, the upper channel 54*b* has a length in the depth direction that is between about 5 to about 10 times longer than the length of the lower channel 54*a*.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A connector, comprising:

an insulative housing including a first section and a second section configured to provide a front wall, a rear wall, a top wall and two opposing side walls, all of the walls cooperatively defining a hollow interior, one of the first and second sections having a rail and the other of the first and second section having a channel configured to receive the rail, the first section providing a first and second vertically aligned, horizontally extending card-receiving slot supported by the front wall; and a set of wafers positioned in the hollow interior, each of the wafers in the set supporting a first and second terminal, each of the first terminals having a contact portion positioned in the first card-receiving slot and tail configured to be mounted on a circuit board and each of the second terminals having a contact portion in the second card-receiving slot and a tail configured to be mounted on the circuit board, wherein the second section is "U" shaped so as to extend around three sides of the set of wafers.

2. The connector of claim 1, wherein the second section has a plurality of registration lugs configured to control a position of the set of wafers with respect to the second section.

3. The connector of claim 2, wherein the set of wafers includes a first wafer with a first depth and a second wafer with a second depth different than the first depth, wherein the registration lugs are configured to selectively engage the first and second wafer based on the variation in depth.

4. The connector of claim 2, wherein the set of wafers includes a plurality of wafers with notches, the notches configured to receive the registration lugs.

5. The connector of claim 1, wherein the first and second card receiving slots include terminal grooves and the contact portions of the terminals are arranged in the corresponding terminal grooves to provide rows of contacts.

6. The connector of claim 5, wherein row of terminal is arranged in a ground, signal, signal pattern with at least two pairs of adjacent signal terminals.

7. A connector, comprising:

an insulative housing including a first section and a second section configured to provide a front wall, a rear wall, a top wall and two opposing side walls, all of the wall cooperatively defining a hollow interior, one the first and second sections having a first rail and the other of the first and second section having a first channel configured to receive the first rail, the first rail and first channel positioned on a first one of the two opposing side walls, the first section providing a first and second card-receiving slot supported by the front wall; and a set of wafers positioned in the hollow interior, each of the wafers in the set supporting a first and second terminal, each of the first terminals having a contact portion positioned in the first card-receiving slot and each of the second terminals having a contact portion in the second card-receiving slot, wherein the second section is "U" shaped so as to extend around three sides of the set of wafers.

8. The connector of claim 7, further comprising a second rail and a second channel, the second rail and second channel being positioned on a second one of the two opposing sides.

9. The connector of claim 7, further comprising a second rail and a second channel, the second rail and second channel being positioned on the first one of the two opposing sides.

10. The connector of claim 9, further comprising a third rail and a third channel, the third channel and the third rail being positioned on a second one of the two opposing sides.

11. A connector, comprising:

an insulative housing including a first section and a second section configured to provide a front wall, a rear wall, a top wall and two opposing side walls, all of the walls cooperatively defining a hollow interior, one of the first and second sections having a rail and the other of the first and second section having a channel configured to receive the rail, the first section providing a first and second vertically aligned, horizontally extending card-receiving slot supported by the front wall; and a set of wafers positioned in the hollow interior, each of the wafers in the set supporting a first and second terminal, each of the first terminals having a contact portion positioned in the first card-receiving slot and each of the second terminals having a contact portion in the second card-receiving slot, wherein the second section is "U" shaped so as to extend around three sides of the set of wafers, wherein the second section has a plurality of registration lugs configured to control a position of the set of wafers with respect to the second section and the set of wafers includes a first wafer with a first depth and a second wafer with a second depth different than the first depth, wherein the registration lugs are configured to selectively engage the first and second wafer based on the variation in depth.

12. The connector of claim 11, wherein each of the first and second terminals includes a tail portion and a body portion that extends between the tail portion and the contact portion.

13. The connector of claim 11, wherein the first rail and first channel are positioned on the first one of the two opposing side walls.

* * * * *